US008729988B1

(12) United States Patent
Maloney

(10) Patent No.: US 8,729,988 B1
(45) Date of Patent: May 20, 2014

(54) TRIP DEVICE SUPPORT FRAME AND TOP FRAME CALIBRATION METHOD

(71) Applicant: Eaton Corporation, Cleveland, OH (US)

(72) Inventor: James Gerard Maloney, Industry, PA (US)

(73) Assignee: Eaton Corporation, Cleveland, OH (US)

( * ) Notice: Subject to any disclaimer, the term of this patent is extended or adjusted under 35 U.S.C. 154(b) by 0 days.

(21) Appl. No.: 13/798,192

(22) Filed: Mar. 13, 2013

(51) Int. Cl.
*H01H 9/00* (2006.01)

(52) U.S. Cl.
USPC ..... 335/205; 335/45

(58) Field of Classification Search
USPC ..... 335/205
See application file for complete search history.

(56) References Cited

U.S. PATENT DOCUMENTS

| | | | | |
|---|---|---|---|---|
| 5,805,038 | A * | 9/1998 | Palmer et al. | 335/42 |
| 6,239,676 | B1 * | 5/2001 | Maloney et al. | 335/6 |
| 6,838,961 | B2 * | 1/2005 | Lias et al. | 335/172 |
| 7,859,369 | B2 * | 12/2010 | Lias et al. | 335/45 |
| 2009/0302978 | A1 * | 12/2009 | Lias et al. | 335/45 |

* cited by examiner

*Primary Examiner* — Shawki S Ismail
*Assistant Examiner* — Lisa Homza
(74) *Attorney, Agent, or Firm* — Eckert Seamans Cherin & Mellott, LLC; David C. Jenkins

(57) ABSTRACT

A trip device support frame for a circuit breaker is provided. The trip device support frame includes a calibration tab that is a cantilever member. As a cantilever member, the calibration tab may be moved, i.e. deformed at a proximal end of the tab, so as to adjust the position of the calibration tab relative to the other portions of the trip device support frame. The calibration tab extends upwardly and the distal end thereof is disposed adjacent a top member of a circuit breaker housing assembly. The circuit breaker housing assembly, and more specifically a housing assembly top member, includes a calibration slot. In this configuration, the calibration tab distal end may be engaged by a calibration tool from the upper side of the circuit breaker rather than a lateral side.

6 Claims, 4 Drawing Sheets

TRIP DEVICE SUPPORT FRAME AND TOP FRAME CALIBRATION METHOD

BACKGROUND OF THE INVENTION

1. Field of the Invention

This invention pertains generally to circuit interrupters and, more particularly, to calibration of circuit breakers including a thermal trip assembly. The invention also relates to methods of thermally calibrating circuit interrupters.

2. Background Information

Electrical switching apparatus, such as circuit interrupters, include an operating mechanism and a trip device, such as a thermal trip assembly and/or a magnetic trip assembly, collectively, "the trip assembly." The operating mechanism is coupled to a number of separable contacts that move between a first, open position and a second, closed position. The trip device is coupled to the separable contacts, e.g. via the operating mechanism, and cause the separable contacts to move from the second, closed position to the first, open position following an over-current event.

The trip device is automatically releasable to effect tripping operations and manually resettable following tripping operations. Examples of circuit breakers including trip mechanisms are disclosed in U.S. Pat. Nos. 5,805,038 and 6,838,961. Such circuit breakers, commonly referred to as "miniature circuit breakers," have been in use for many years and their design has been refined to provide an effective, reliable circuit breaker which can be easily and economically manufactured and tested. As such, the ease of test of such circuit breakers is of importance.

Circuit breakers of this type include, for example, a non-conductive housing assembly in which the other components are disposed. The separable contacts include a fixed contact attached to the housing assembly and a movable contact coupled to the operating mechanism. The operating mechanism includes a movable handle that extends outside of the housing assembly. Movement of the separable contacts is accomplished by the operating mechanism. The trip device includes a cradle and the previously mentioned trip assembly including a thermal trip assembly and/or magnetic trip assembly. The cradle is coupled to a spring and disposed between the trip device and the operating arm. The components further include a frame to which the other components are coupled.

The frame includes a generally planar body that is coupled to a sidewall in the housing assembly. The trip assembly is coupled to the frame. The cradle engages an opening on the trip assembly. The cradle is biased, e.g. by a spring, and if free to move will cause the operating mechanism to move the separable contacts from the second, closed position to the first, open position.

The thermal trip assembly includes a bimetal element (hereinafter, "bimental"). When exposed to a first predetermined over-current condition, the bimetal is heated and deforms. The deformation of the bimetal moves the opening on the trip assembly away from the cradle thereby releasing the cradle and opening the separable contacts, as described above. The magnetic trip assembly includes a magnetic yoke that is flexibly coupled to the bimetal. The opening on the trip assembly is disposed on the magnetic yoke. In the event of an instantaneous second predetermined over-current condition, wherein the second predetermined over-current condition is higher than the first predetermined over-current condition, the bimetal generates a magnetic field that causes the magnetic yoke to move toward the bimetal. When the magnetic yoke moves, the opening on the trip assembly moves away from the cradle thereby releasing the cradle and opening the separable contacts, as described above. Thus, the position of the trip assembly relative to the cradle, and more specifically the position of the opening on the trip assembly relative to the cradle, affects the trip conditions, especially the thermal trip condition. That is, generally, if the trip assembly is closer to the cradle, the bimetal must deflect a greater amount before the cradle is released.

As noted above, the trip assembly is coupled to the frame. Thus, movement, or more specifically a deformation, of the frame affects the position of the trip assembly relative to the cradle. As such, deforming the frame may be used to calibrate the trip assembly. A detailed explanation of calibrating a trip assembly by deforming a frame is set forth in U.S. Pat. Nos. 6,239,676 and 7,859,369. As noted therein, present frames include an opening with a calibration slot. That is, the frame is a planar body having an opening with a radial slot. In selected areas about the opening and calibration slot, the frame body is attenuated. Thus, a calibration tool was inserted into the calibration slot and twisted. This motion caused the frame body to deform at the attenuated portions, thereby deforming the frame body in a first direction and moving the trip assembly. To deform the frame body in the opposite direction, a two-pronged tool must be used so as to engage the frame body both from within the calibration slot as well as on the perimeter of the frame body.

As detailed in U.S. Pat. Nos. 6,239,676 and 7,859,369, the calibration tool must engage the frame body from a direction generally normal to the plane of the frame body. That is, the calibration tool must enter on a lateral side of the circuit breaker housing assembly. Following calibration, multiple circuit breakers may be coupled together. In this configuration, it is difficult, or in some instances impossible, to recheck the calibration after joining the circuit breakers because there little or no lateral access to the circuit breaker. That is, providing lateral access for the calibration tool is a disadvantage.

Further, as shown in FIG. 1, the frame body 1 must be shaped to define the opening 2 and the calibration slot 3 into which the calibration tool is inserted. That is, the frame body 1 must include a "loop" 4 that extends from medial portion of the frame body 1 to a location near the upper end 5 of one end of the frame body 1. Thus, the loop 4 defines the opening 2. That is, as sued herein, a "loop" is a portion of a support frame body that defines a part of a circular opening having a calibration slot and which is disposed generally opposite the calibration slot. Further, because the cradle biases the frame toward the bottom of the circuit breaker housing assembly, the frame may slowly deform over time. This deformation is known as "frame creep" and may move the trip assembly out of calibration.

Thus, the size, shape, configuration and orientation of the frame body, including lateral access for the calibration tool, is a disadvantage. There is, therefore, room for improvement in the frame as well as in methods of thermally calibrating circuit interrupters.

SUMMARY OF THE INVENTION

These needs, and others, are met by at least one embodiment of this invention which provides a trip device support frame including a calibration tab that is a cantilever member. As a cantilever member, the calibration tab may be moved, i.e. deformed at the proximal end of the tab, so as to adjust the position of the calibration tab relative to the other portions of the frame body. The trip assembly is coupled to and moves with the calibration tab. In one embodiment, the calibration tab extends upwardly and the distal end thereof is disposed adjacent a top member of the circuit breaker housing assembly. The circuit breaker housing assembly, and more specifically a housing assembly top member, includes a calibration slot. In this configuration, the calibration tab distal end may be engaged by a calibration tool from the upper side of the circuit breaker rather than a lateral side.

Further, because the calibration tab is a cantilever member, the frame body does not include a loop that defines the opening adjacent a calibration slot. That is, the support frame body of the disclosed concept is smaller, and is therefore less expensive in terms of material cost, than known frames.

Further, the circuit breaker housing assembly includes a boss extending upwardly from a bottom surface. The boss is disposed below the frame body and the lower surface of the frame body engages the boss. In this configuration, the bias of the cradle is substantially absorbed by the boss and the circuit breaker is subject to less "frame creep."

Accordingly, the disclosed concept provides for a trip device support frame for a circuit breaker assembly. The trip device support frame includes a body including a calibration tab, wherein the calibration tab is a cantilever member. The disclosed concept further provides for a circuit breaker assembly including a housing assembly, a trip device and a support frame. The housing assembly includes a bottom member, a top member, and a number of sidewalls extending between the bottom member and the top member. The support frame includes a body with a calibration tab, wherein the calibration tab is a cantilever member. The support frame is coupled to a housing assembly sidewall. The trip device is coupled to the support frame. In an exemplary embodiment, access for a calibration tool is through the housing assembly top member.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

Figure 1:
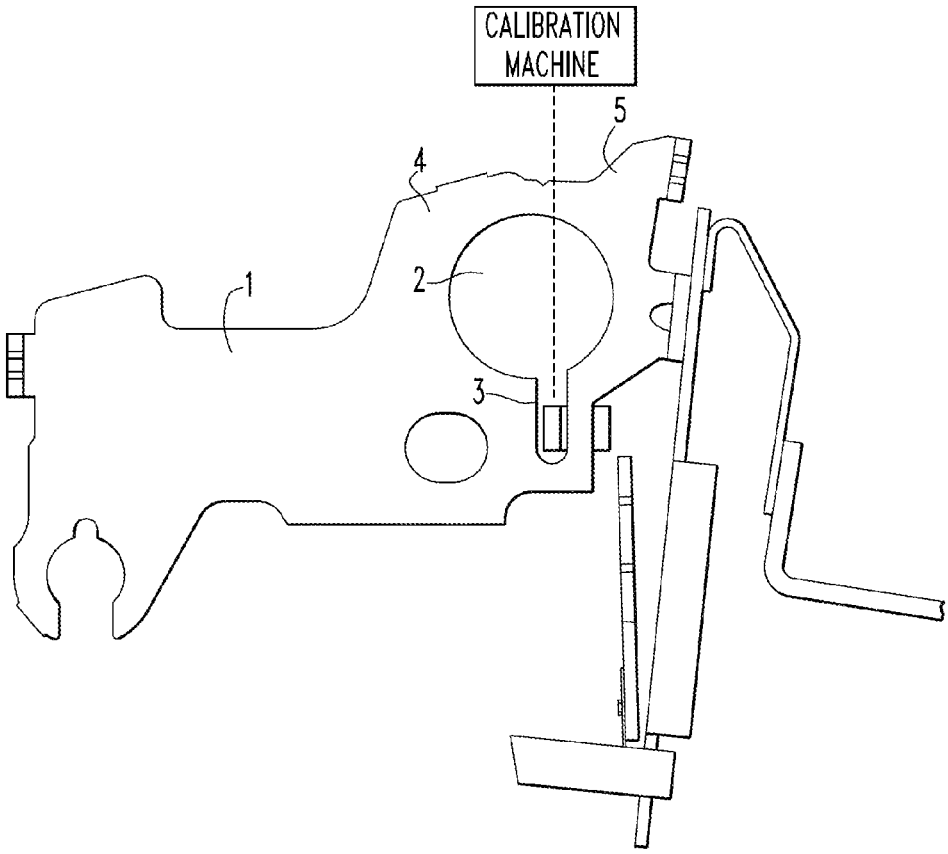
FIG.1 PRIOR ART
FIG. 1 is a side view of a prior art support frame body.

As used herein, "coupled" means a link between two or more elements, whether direct or indirect, so long as a link occurs. An object resting on another object held in place only by gravity is not "coupled" to the lower object unless the upper object is otherwise maintained substantially in place. That is, for example, a book on a table is not coupled thereto, but a book glued to a table is coupled thereto.

As used herein, "directly coupled" means that two elements are directly in contact with each other.

As used herein, "fixedly coupled" or "fixed" means that two components are coupled so as to move as one while maintaining a constant orientation relative to each other. Similarly, two or more elements disposed in a "fixed relationship" means that two components maintain a substantially constant orientation relative to each other. As used herein, the word "unitary" means a component is created as a single piece or unit. That is, a component that includes pieces that are created separately and then coupled together as a unit is not a "unitary" component or body.

As used herein, "associated" means that the identified components are related to each other, contact each other, and/or interact with each other. For example, an automobile has four tires and four hubs, each hub is "associated" with a specific tire. As a further example, a circuit breaker may include a number of pair of separable contacts; each pair of separable contacts may interact with similar elements, such as but not limited to an arc chamber. Thus, each pair of separable contacts has an "associated" arc chamber.

As used herein, "engage," when used in reference to gears or other components having teeth, means that the teeth of the gears interface with each other and the rotation of one gear causes the other gear or other component to rotate/move as well. As used herein, "engage," when used in reference to components not having teeth means that the components are biased against each other.

Directional phrases used herein, such as, for example and without limitation, top, bottom, left, right, upper, lower, front, back, and derivatives thereof, relate to the orientation of the elements shown in the drawings and are not limiting upon the claims unless expressly recited therein.

As used herein, "correspond" indicates that two structural components are similar in size, shape or function. With reference to one component being inserted into another component or into an opening in the other component, "corresponding" means components are sized to engage or contact each other with a minimum amount of friction. Thus, an opening which corresponds to a member is sized slightly larger than the member so that the member can pass through the opening with a minimum amount of friction. This definition is modified if the two components are said to fit "snugly" together. In that situation, the difference between the size of the components is even smaller whereby the amount of friction increases. If one or more components are resilient, a "snugly corresponding" shape may include one component, e.g. the component defining the opening being smaller than the component inserted therein. Further, as used herein, "loosely correspond" means that a slot or opening is sized to be larger than an element disposed therein. This means that the increased size of the slot or opening is intentional and is more than a manufacturing tolerance.

As used herein, a "coupling" or a "coupling component" is one element of a coupling assembly. That is, a coupling assembly includes at least two elements, or components, that are structured to be coupled together. It is understood that the elements of a coupling assembly correspond to each other or are otherwise structured to be joined together. For example, in a coupling assembly, if one coupling element is a bolt, the other coupling element is a nut. Further, it is understood that the two elements of a coupling assembly may not be described at the same time. Further, it is understood that, unless otherwise noted, the locations of two coupling components may be reversed. For example, if the coupling assembly includes a first coupling component, e.g. a lug, disposed on one element and a second coupling component, e.g. a socket, disposed on another element, the locations of the first and second coupling components may be reversed.

As used herein, "at" means on or near.

As used herein "cantilever member" means an elongated member that is coupled, or directly coupled, to another element at one end.

As used herein, a "calibration tab" on a trip device support frame is a tab that is structured to move between an initial configuration and number of other configurations. That is, not all tabs on a trip device support frame are "calibration tabs." Specifically, a tab, such as the mounting tab for a trip assembly, is not a "calibration tab." Further, any tab extending generally perpendicular to the plane of the trip device support frame is not a "calibration tab."

Figure 2:
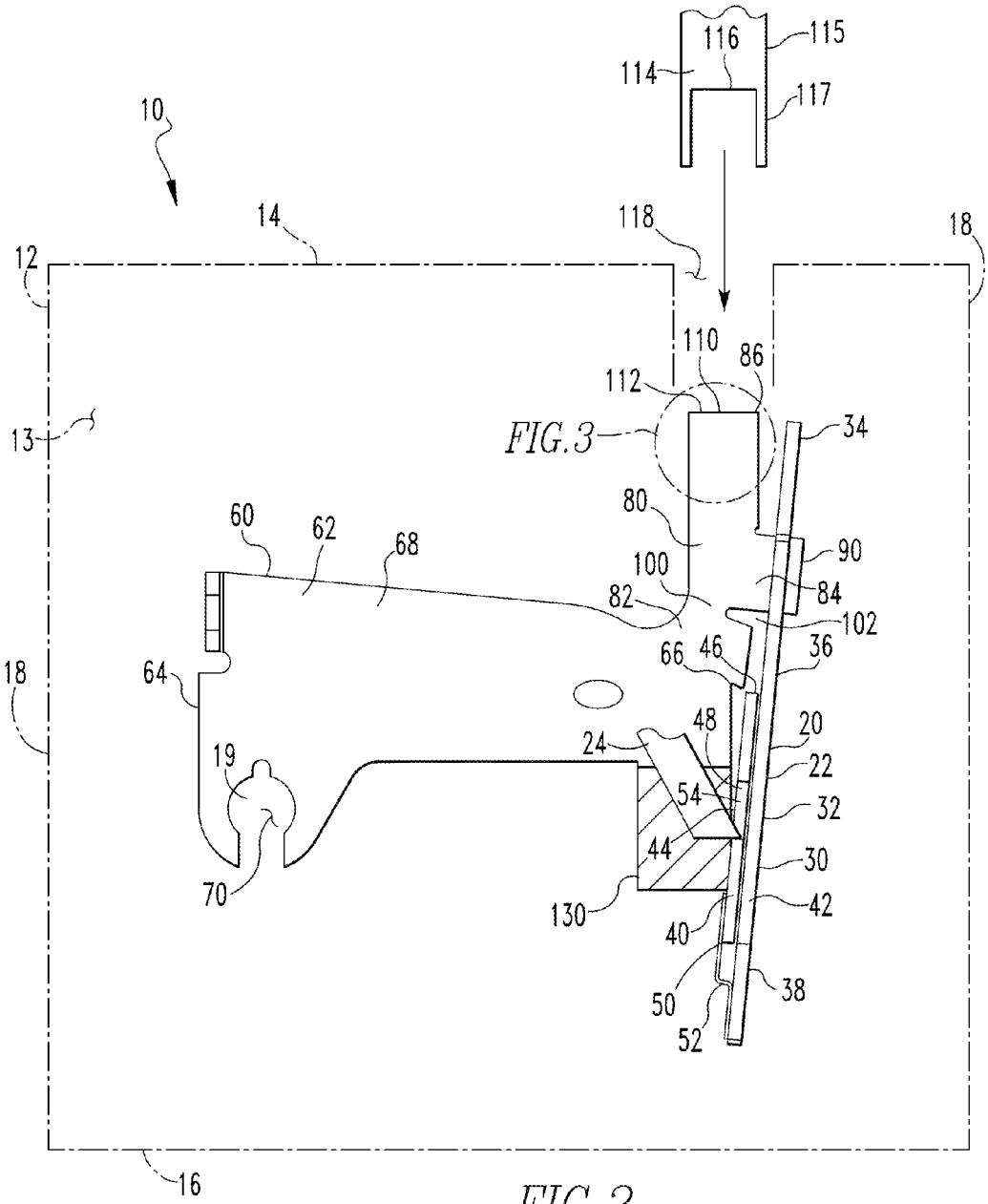
FIG. 2 is a schematic, cross-sectional side view of a circuit breaker.

As is known, and as shown in FIG. 2, a circuit breaker 10 includes a non-conductive housing assembly 12 in which other components are disposed. The other components include, separable contacts, and an operating mechanism (neither shown). The separable contacts include a fixed contact and a movable contact (neither shown). The fixed contact is coupled to, or directly coupled to, to the housing assembly 12. The movable contact is coupled to the operating mechanism. The operating mechanism includes a movable handle (not shown) that extends outside of the housing assembly 12. The operating mechanism also includes components such as an operating arm (not shown), upon which the movable contact is disposed. Movement of the separable contacts is accomplished by the operating mechanism. That is, the separable contacts move between a first, open position, wherein the contacts are not in electrical communication, and a second, closed position, wherein the contacts are in electrical communication.

The circuit breaker housing assembly 12 includes a top member 14, a bottom member 16 and a number of depending sidewalls 18 which define a generally enclosed space 13. Typically, the circuit breaker 10 is generally rectangular, thus there are typically four sidewalls 18. In an exemplary embodiment, the top member 14, bottom member 16 and the sidewalls 18 are generally planar. The sidewalls 18 may include perpendicular extensions, i.e. lugs 19 that extend generally horizontally. Further, bottom member 16 includes an upwardly extending boss 130 as described below.

The circuit breaker 10 also includes a trip device 20. The trip device 20 includes a trip assembly 22 and a cradle 24 (shown schematically). The cradle 24 is a link between the trip device 20 and the operating mechanism. The cradle 24 is biased downwardly by a biasing device such as, but not limited to, a spring (not shown). The cradle 24 engages a trip assembly opening 54 (described below). When the trip assembly 22 moves, the trip assembly opening 54 moves away from the cradle 24 thereby releasing the cradle 24. The bias applied to the cradle 24 causes the cradle to move. Movement of the cradle 24 actuates the operating mechanism and causes the contacts to move from the second, closed position to the first, open position.

The trip assembly 22 include a thermal trip assembly 30 and/or a magnetic trip assembly 40. The thermal trip assembly 30 includes a bimetal 32. The bimetal 32 includes an upper, first end 34, a medial portion 36 and a lower, second end 38. The current passing through the circuit breaker 10 passes through the bimetal 32. The bimetal 32 includes two different metals which have different characteristics. For example, at a first predetermined over-current, the bimetal 32 is subjected to sufficient heat that the bimetal 32 expands. The different metals, however, expand at different rates, thereby causing the bimetal 32 to deform and, more specifically, curl. As noted below, the bimetal upper, first end 34 is coupled to a trip device support frame 60, thus, the deformation, i.e. curl, described above causes the bimetal lower, second end 38 to move in a counter-clockwise direction (as shown in the figures).

The magnetic trip assembly 40 includes a magnetic yoke 42 and an armature 44. The yoke 42 is disposed on, and coupled, or directly coupled to, the bimetal medial portion 36. Flow of overload current, measured in amps, above a second, higher predetermined value through a bimetal 32 induces magnetic flux around the bimetal 32. This flux is concentrated by magnetic yoke 42. The armature 44 is made from a ferrous metal and includes an upper, first end 46, a medial portion 48 and a lower, second end 50. The armature lower, second end 50 is flexibly coupled to the bimetal lower, second end 38, e.g. by a leaf spring 52. In an exemplary embodiment, leaf spring 52 is made from spring steel. Further, the armature medial portion 48 includes a trip assembly opening 54. An overload current above the second higher predetermined value generates a magnetic force of such a strength that the armature 44 is attracted toward the magnetic yoke 42 resulting in the flexing of the spring 52. This causes the armature 44 to move to the right (as shown in the Figures).

Thus, following an over-current condition above either, or both, the first or second predetermined value causes the armature 44 to move to the right (as shown in the Figures). That is, when the bimetal 32 deforms, the bimetal lower, second end 38 moves in a counter-clockwise direction (as shown in the figures). As the armature 44 is coupled to the bimetal lower, second end 38, movement of the bimetal lower, second end 38 causes the armature 44 to move as well. As noted above, the cradle 24 engages the trip assembly opening 54. Thus, when the armature 44 moves to the right (as shown in the figures), the trip assembly opening 54 moves away from the cradle 24. When the trip assembly opening 54 moves past the cradle 24, the cradle is free to move and the circuit breaker 10 is tripped, as described above. Thus, the trip condition(s) for the circuit breaker 10 is affected by the position of the trip assembly 22, and more specifically the trip assembly opening 54, relative to the cradle 24.

The trip assembly 22 is coupled, or directly coupled, to a trip device support frame 60. The trip device support frame 60 includes an elongated body 62 having a first end 64, a second end 66, and a medial portion 68. That is, the support frame body 62 is elongated in a direction extending from the first end 64 to the second end 66. Accordingly, as used herein, a "longitudinal axis" means a line extending generally parallel to the plane of the housing assembly bottom member 16 and extending from the support frame body first end 64 to the support frame body second end 66. Similarly, a "longitudinal direction" means generally parallel to the longitudinal axis.

The trip device support frame body 62 is, in an exemplary embodiment, generally planar and made from metal such as, but not limited to, steel. The trip device support frame body 62 is a substantially continuous body. As used herein, a "substantially continuous body" is a body having a limited number of openings therethrough wherein the opening are of a limited size. As used herein, a "substantially continuous body" includes opening for mounting lugs 19 and does not include a generally unfilled circular opening and calibration slot as is known in the art. The trip device support frame body 62 does include smaller mounting openings 70. The mounting openings 70 are disposed over, and generally correspond to, the housing assembly sidewall lugs 19. Such openings are coupling components that allow the support frame body 62 to be coupled, and more specifically directly coupled and fixed, to the housing assembly 12.

The mounting openings 70 do not act as openings that exclude a body from being a "substantially continuous body" because the mounting openings 70 are "filled" openings. That is, as used herein, a "filled" opening is an opening in a body that is substantially occupied by another element. Conversely, as used herein, an "unfilled" opening is generally an empty space. Further, in this configuration, the plane of the trip device support frame body 62 is disposed in a generally vertical plane within the circuit breaker housing assembly enclosed space 13.

The trip device support frame body 62 includes a calibration tab 80. The calibration tab 80 is a generally planar, elongated member extending from the trip device support frame body second end 66. As shown, the calibration tab 80 extends upwardly. In an exemplary embodiment, the plane of the calibration tab 80 is the same general plane as the trip device support frame body 62. In an alternate embodiment, not shown, the plane of the calibration tab 80 is offset, but generally parallel to, the plane of the device support frame body 62.

The calibration tab 80 includes a proximal end 82, a medial portion 84 and a distal end 86. The calibration tab 80 also includes a mounting tab 90. The mounting tab 90 extends from the calibration tab medial portion 84. Further, the mounting tab 90 extends generally perpendicular to the plane of the calibration tab 80 and the trip device support frame body 62. The trip assembly 22 is coupled to the mounting tab 90 and, more specifically, the bimetal upper, first end 34 is coupled to the mounting tab 90. As the trip assembly 22 is coupled to the mounting tab 90, and as the mounting tab 90 is fixed to the housing assembly 12, the motion of the thermal trip assembly 30 and/or a magnetic trip assembly 40 following an over-current condition, as described above, causes the armature 44 to move relative to the cradle 24.

The calibration tab 80 further includes a number of attenuated portions 100. As used herein, an "attenuated portion" is a portion of the calibration tab 80 that has been intentionally weakened. Thus, an "attenuated portion" includes any area wherein the dimensions of the calibration tab 80 have been reduced. As shown, in an exemplary embodiment, a notch 102 at the calibration tab proximal end 82 creates an attenuated portion 100. Attenuated portions 100 may also be created by openings or a thinning of the calibration tab 80 in a direction normal to the plane of the calibration tab 80. As used herein, a construct, such as but not limited to, a notch or opening that creates an attenuated portion 100 will be considered part of the attenuated portion 100. In an exemplary embodiment, there is a single notch 102 at the calibration tab proximal end 82. In this configuration, the calibration tab 80 is structured to move in a generally longitudinal direction, i.e. in a direction generally parallel to, or generally in the plane of, the support frame body 62. It is noted that such movement is accomplished by deforming the attenuated portion(s) 100. Such a deformation allows the calibration tab distal end 86 to rotate about and/or move relative to, the calibration tab proximal end 82. Accordingly, as used herein, the "motion," "movement," or allowing the calibration tab 80 to "move" includes both rotational and linear movement of the calibration tab 80.

Figure 3:
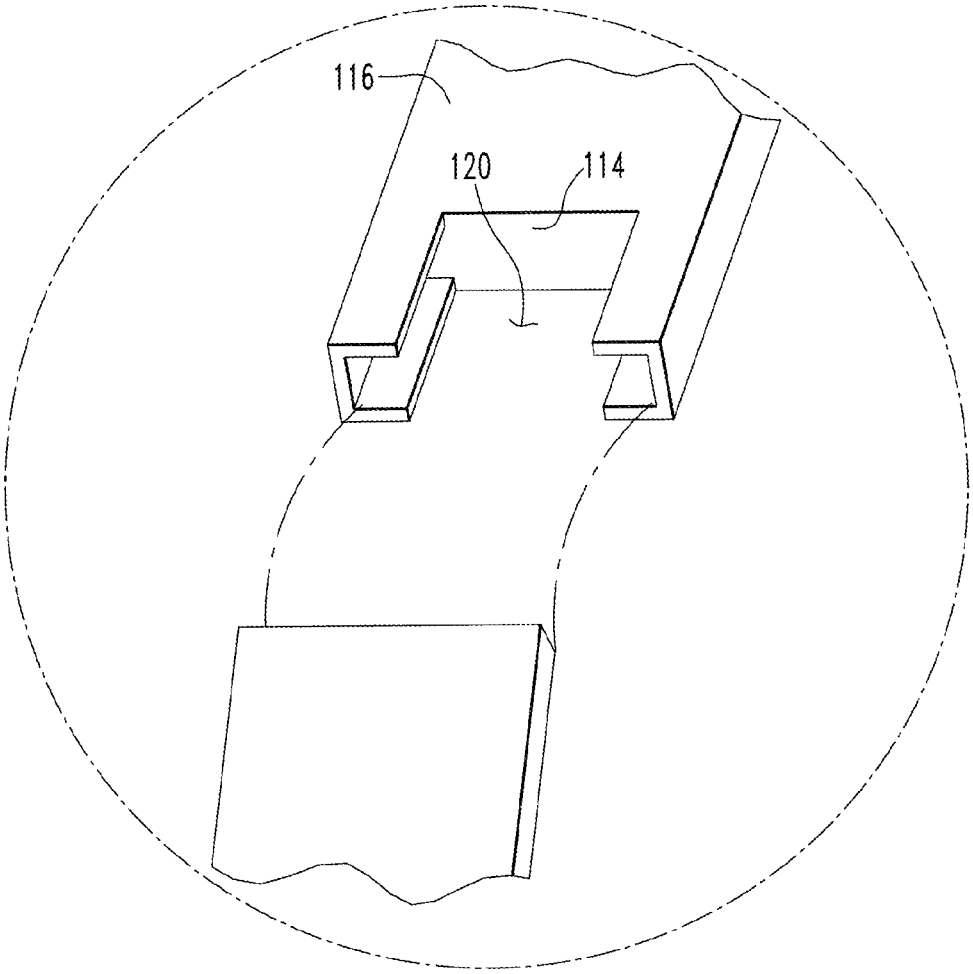
FIG. 3 is a detail isometric view of a calibration cap.
Figure 4:
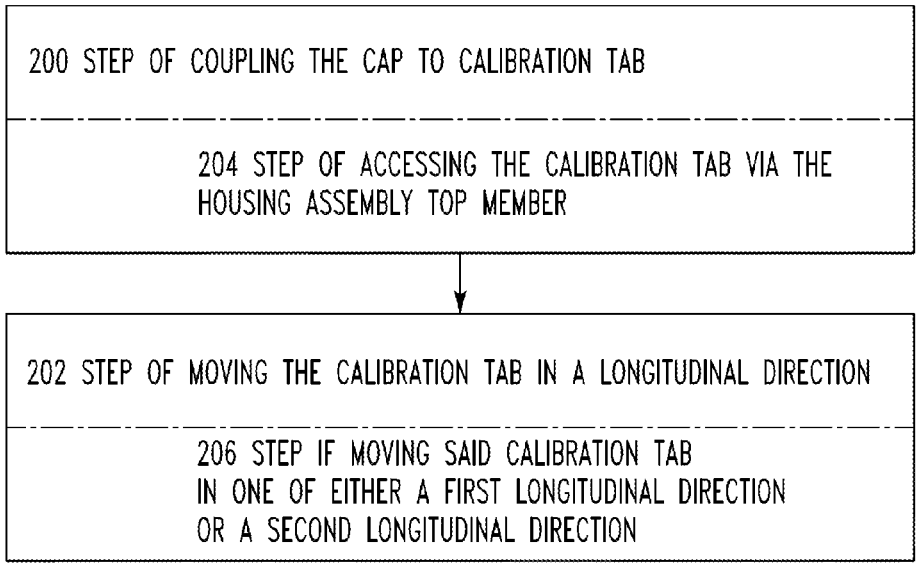
FIG. 4 is a flow chart of the steps of the method of calibrating a circuit breaker.

The calibration tab distal end 86 is a first coupling component 110. In an exemplary embodiment, calibration tab distal end 86 is a lug 112. The calibration tab distal end coupling component 110 is structured to be engaged by a second coupling component 114 and, more specifically, a calibration cap 116. The calibration cap 116, also shown in FIG. 3, is part of the housing assembly 12. The circuit breaker housing assembly 12, and more specifically the housing assembly top member 14, includes a housing assembly calibration slot 118. It is noted that a "housing assembly calibration slot 118" is a slot in the housing assembly 12 and not a "calibration slot" in the support frame body 62 as in the prior art.

The housing assembly calibration slot 118 is elongated and extends in a direction generally parallel to the longitudinal axis of the support frame body 62. The calibration cap 116 is sized to be movably disposed in the housing assembly calibration slot 118. That is, as used herein, "sized to be movably disposed" means that the calibration cap 116 has a cross-sectional area that is smaller than the housing assembly calibration slot 118. Thus, the calibration cap 116 may be moved, and in an exemplary embodiment, moved in a longitudinal direction, within the housing assembly calibration slot 118.

The calibration cap 116 includes an upper, first end 115 and a lower, second end 117. The calibration cap lower end 117 defines a socket 120, which is the second coupling component 114. That is, the calibration cap socket 120 corresponds to the calibration tab lug 112. When the calibration cap 116 is disposed in the housing assembly calibration slot 118, the calibration cap second end 117 is disposed within the housing assembly enclosed space 13. That is, the calibration cap second end 117 is passed through the housing assembly calibration slot 118 and the housing assembly top member 14. The calibration cap socket 120 is disposed over the calibration tab lug 112, thereby coupling the calibration cap 116 to the calibration tab 80. More specifically, the calibration cap second coupling component 114 is coupled to the calibration tab first coupling component 110.

In this configuration, movement of the calibration cap 116 in the housing assembly calibration slot 118 causes the calibration tab 80 to move. More specifically, the calibration tab 80 moves in a direction generally parallel to the longitudinal axis of the support frame body 62, i.e. in a generally longitudinal direction. The movement of the calibration tab 80 is accomplished by deforming the support frame body 62 at the attenuated portion 100. Thus, the support frame body 62 remains substantially stationary relative to the housing assembly 12, but the calibration tab 80 may move relative to the housing assembly 12.

As noted above, the trip assembly 22 is coupled to the calibration tab 80. Further, as discussed above, moving the calibration tab 80 relative to the housing assembly 12 allows for calibrating the trip assembly 22. Thus, the configuration described above allows for calibrating the trip assembly 22. Moreover, this calibration is accomplished by accessing the calibration tab 80 via the housing assembly top member 14. That is, calibration of the circuit breaker 10 no longer requires lateral access to the housing assembly 12.

The disclosed housing assembly 12, and more specifically the bottom member 16, further includes an upwardly extending boss 130. The upwardly extending boss 130 is disposed adjacent the support frame body second end 66. As noted above, a biased cradle 24 biases the support frame body second end 66 toward the housing assembly bottom member 16. The support frame body second end 66 engages the boss 130 thereby resisting "creep," i.e. a slow deformation of the trip device support frame body 62 caused by the cradle 24 bias.

Accordingly, a method of calibrating a circuit breaker using the elements described above includes the steps of: coupling 200 the calibration cap 116 to the calibration tab 80, and, moving 202 the calibration tab 80 in a longitudinal direction. The step of coupling 200 the calibration cap 116 to the calibration tab 80 includes the step of accessing 204 the calibration tab 80 via the housing assembly top member 14. Further, the step of moving 202 the calibration tab 80 in a longitudinal direction includes the step of moving 206 said calibration tab in one of either a first longitudinal direction or a second longitudinal direction. As used herein, a "first longitudinal direction" means in a direction from the center of the support frame body 62 toward the support frame body first end 64, and a "second longitudinal direction" means in a direction from the center of the support frame body 62 toward the support frame body second end 66. That is, the calibration tab 80 may be used to move the calibration tab 80 in two directions. In this configuration, the predetermined over-current conditions, and especially the first predetermined over-current condition associated with the thermal trip assembly 30, may be adjusted to be at a higher or lower value.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of invention which is to be given the full breadth of the claims appended and any and all equivalents thereof.

What is claimed is:

1. A trip device support frame for a circuit breaker assembly, said trip device support frame comprising:

a body including a calibration tab;

wherein said calibration tab is a cantilever member;

said body has a first end, a second end, and a medial portion;

said calibration tab extending from said body second end;

wherein said calibration tab further includes a number of attenuated portions; and wherein said calibration tab distal end is a coupling component.

2. A circuit breaker assembly comprising:

a housing assembly including a bottom member, a top member, and a number of sidewalls extending between said bottom member and said top member;

a trip device;

a support frame including an elongated body with a calibration tab;

said support frame coupled to a housing assembly sidewall;

said trip device coupled to said support frame;

wherein said calibration tab is a cantilever member;

said support frame body has a first end, a second end, and a medial portion;

said calibration tab extending from said support frame body second end wherein said calibration tab further includes a number of attenuated portions;

said calibration tab includes a proximal end and a distal end;

said number of attenuated portions include a notch at said calibration tab proximal end; and wherein said calibration tab distal end is a first coupling component.

3. The circuit breaker assembly of claim 2 wherein:

said housing assembly top member includes a housing assembly calibration slot and a calibration cap;

said calibration tab distal end is disposed adjacent to said housing assembly calibration slot;

said calibration cap defining a second coupling component;

said calibration cap sized to be movably disposed in said housing assembly calibration slot; and said calibration cap second coupling component sized to correspond to said calibration tab first coupling component.

4. The circuit breaker assembly of claim 2 wherein:

said calibration tab distal end has a longitudinal axis extending generally parallel to the longitudinal plane of the support frame body;

said calibration tab structured to deform at said attenuated portions; and said calibration tab distal end structured to move in a direction generally parallel to said calibration tab distal end longitudinal axis.

5. A circuit breaker assembly comprising:

a housing assembly including a bottom member, a top member, and a number of sidewalls extending between said bottom member and said top member;

a trip device;

a support frame including an elongated body with a calibration tab;

said support frame coupled to a housing assembly sidewall;

said support frame coupled to said support frame;

wherein said calibration tab is a cantilever member;

said housing assembly to member includes a housing assembly calibration slot;

said calibration tab distal end is disposed adjacent to said housing assembly calibration slot;

said housing assembly includes a calibration cap;

said calibration cap defining a second coupling component; and said calibration cap second coupling component sized to correspond to said calibration tab first coupling component.

6. The circuit breaker assembly of claim 5 wherein:

said calibration tab includes a number of attenuated portions;

said calibration tab structured to deform at said attenuated portions; and said calibration tab distal end structured to move in a generally longitudinal direction.

* * * * *